US008770454B1

(12) United States Patent
Lutz

(10) Patent No.: US 8,770,454 B1
(45) Date of Patent: Jul. 8, 2014

(54) PERSONAL TRASH BAG HOLDING APPARATUS

(76) Inventor: Shane Lutz, Coronation (CA)

( * ) Notice: Subject to any disclaimer, the term of this patent is extended or adjusted under 35 U.S.C. 154(b) by 433 days.

(21) Appl. No.: 13/186,905

(22) Filed: Jul. 20, 2011

(51) Int. Cl.
*A45F 3/04* (2006.01)
*A45F 3/08* (2006.01)
*A45F 3/02* (2006.01)

(52) U.S. Cl.
USPC ..... 224/625; 224/262; 224/928; 224/260

(58) Field of Classification Search
USPC ..... 224/257, 260, 262, 625, 928
See application file for complete search history.

(56) References Cited

U.S. PATENT DOCUMENTS

| | | | | | |
|---|---|---|---|---|---|
| 554,412 | A * | 2/1896 | Choate | 224/611 |
| 606,274 | A * | 6/1898 | Choate | 224/611 |
| 730,325 | A * | 6/1903 | Wilson et al. | 224/625 |
| 1,172,044 | A * | 2/1916 | Pope | 224/625 |
| 1,188,955 | A * | 6/1916 | Leonard | 383/127 |
| 1,569,157 | A * | 1/1926 | Thompson | 224/610 |
| 1,865,353 | A * | 6/1932 | Brewster | 224/608 |
| 3,893,699 | A * | 7/1975 | Morris | 280/659 |
| 3,997,092 | A * | 12/1976 | Pogwizd | 224/610 |
| 4,325,503 | A * | 4/1982 | Swinney | 224/148.6 |
| 4,972,982 | A * | 11/1990 | Harbour | 224/270 |
| 5,016,791 | A * | 5/1991 | Burow | 224/148.6 |
| 5,020,751 | A | 6/1991 | Larkin | |
| 5,183,339 | A | 2/1993 | Williams | |
| 5,400,989 | A | 3/1995 | Gaskill | |
| 5,489,051 | A * | 2/1996 | Robinson | 224/148.4 |
| 5,641,138 | A * | 6/1997 | Cronk et al. | 248/99 |
| 5,836,553 | A * | 11/1998 | Bergaila | 248/99 |
| 5,915,606 | A * | 6/1999 | Jensen | 224/148.6 |
| 6,416,023 | B1 | 7/2002 | Satsky | |
| 6,517,034 | B1 * | 2/2003 | Kinchen | 248/99 |
| 6,554,810 | B1 * | 4/2003 | Wilk et al. | 604/323 |
| 6,679,462 | B1 | 1/2004 | Valdez | |
| 6,945,440 | B1 * | 9/2005 | Ford | 224/148.6 |
| 2010/0006712 | A1 * | 1/2010 | Stravitz | 248/99 |

* cited by examiner

*Primary Examiner* — Justin Larson
*Assistant Examiner* — Lester L Vanterpool
(74) *Attorney, Agent, or Firm* — Robert C. Montgomery; Montgomery Patent and Design LLC

(57) ABSTRACT

An apparatus for holding trash bags and facilitating trash pick up includes a bag holding base ring and interchangeable insert ring and opening ring which selectably attach to the base ring. The trash bag is secured between the opposing pairs of rings, which are each attachable to a waist belt worn by the user or can be carried individually by an attachable handle. The insert ring also includes a stripping membrane along a top surface to remove the refuse from a trash picker and retain it inside the bag.

16 Claims, 10 Drawing Sheets

PERSONAL TRASH BAG HOLDING APPARATUS

RELATED APPLICATIONS

The present invention was first described in a notarized Official Record of Invention on May 12, 2010, that is on file at the offices of Montgomery Patent and Design, LLC, the entire disclosures of which are incorporated herein by reference.

FIELD OF THE INVENTION

The present invention relates generally to trash bag holders, and in particular, to a personal trash bag holding apparatus which provides a stiffening frame for selectably holding a trash bag open and an insertable frame for selectably covering the opening of the trash bag and having a stripping membrane for insertion of refuse.

BACKGROUND OF THE INVENTION

While much of our everyday trash is collected in one place such as a kitchen, bathroom or garage, there are occasions where it must be gathered and collected over a large physical area. An example of this is when picking up leaves, twigs and other yard waste. Another is when workers must pick up trash and litter from parks or along the sides of roads and highways or at other public venues after large events. Such situations call for the worker to carry a trash receptacle with them as they walk. Many carry a trash can with a liner, but such a combination quickly becomes heavy and bulky. Others carry just the liner, but it becomes difficult to keep the bag open when placing refuse inside.

It is also common for the collector or worker to use long tongs or a sharp stick as a collection aid to pick up refuse. This means that the user must touch the refuse when removing it from the collection aid to place it inside the trash receptacle. This extra step not only takes time, but exposes the worker to extra hazards.

Various garbage and trash bag holders, supports, and frames are known in the art. These devices include various designs and are typically used to hold the mouth of the bag open and support the bag in an upright and fillable position, similar to as if the bag was disposed within a trash can.

Examples of these devices can be seen by reference to various U.S. patents, including: U.S. Pat. No. 5,020,751, issued to Larkin; U.S. Pat. No. 5,183,339, issued to Williams; U.S. Pat. No. 5,400,989, issued to Gaskill; U.S. Pat. No. 6,416,023, issued to Satsky; and U.S. Pat. No. 6,679,462, issued to Valdez.

While these devices may achieve their purported objectives each suffers from one (1) or more disadvantage or deficiency related to design or utilization. Particularly, none of these devices provide for both self supported and carried modes of utilization. Additionally, none of these devices provide protection for the trash bag when being filled with a refuse picking tool. n these and other respects the devices provided are examples of conventional concepts designed primarily for the purpose of holding a bag open.

SUMMARY OF THE INVENTION

The inventor has therefore recognized the inherent problems and lack in the art and observed that there is a need for an apparatus which allows for trash pick-up and collection over a wide area in a manner which addresses the above problems. In accordance with the invention, it is an object of the present disclosure to solve at least one (1) of the aforementioned disadvantages.

The inventor recognized these problems and has addressed this need by developing a personal trash bag holding apparatus that allows the user to quickly pick up trash, yard waste, and similar items and contain them within a trash can liner in a manner which is quick, easy, and effective. The inventor has thus realized the advantages and benefits of providing the trash bag holding apparatus which includes a base assembly having an opening therethrough for receiving a trash bag. The trash bag is inserted such that an upper perimeter edge of the trash bag is foldable over a circumferential edge of the base assembly. An insert assembly is provided having a central insert opening for receiving refuse and is selectably attachable to the base assembly to retain the upper perimeter of the trash bag between opposing surfaces. An opening ring assembly is also provided having an opening and being selectably attachable to the base assembly in place of the insert assembly to retain the upper perimeter of the trash bag between opposing surfaces to support the trash bag in an open position.

A strap is also provided which is wearable around the shoulders of a user and removably attachable between a pair of base assemblies to support a forward end. A belt is also provided which is wearable around the waist of the user such that the pair of base assemblies are each removably attachable to a pair of belt fasteners located on the belt.

In an embodiment, the base assembly includes a base ring having a plurality of twist fasteners rotatably attached to an upper surface. The insert assembly includes an insert ring having a plurality of fastener apertures to receive the twist fasteners when the insert ring is selectably attached to the base ring. The opening ring assembly includes an opening ring also having a plurality of fastener apertures to receive the twist fasteners when the opening ring is selectably attached to the base ring.

In another embodiment, the base ring includes a groove disposed circumferentially along an outside surface. The insert ring and the opening ring each include a downwardly protruding lip having an inwardly protruding tongue to matingly engage the groove when the insert ring or the opening ring is selectably attached to the base ring.

In another embodiment, a clamping ring is provided which is adapted to circumferentially enclose the base ring and the insert ring or the opening ring when selectably mated together to attach them together.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | personal trash bag holding apparatus |
| 20 | bag holding assembly |
| 21 | bag opening assembly |
| 30 | base assembly |
| 32 | base ring |
| 33 | twist fastener |
| 34 | head feature |
| 35 | shaft |
| 36 | keeper feature |
| 38 | male belt fastener |
| 40 | threaded aperture |
| 42 | handle |
| 50 | insert assembly |
| 52 | insert ring |
| 54 | upper panel |
| 56 | stripping membrane |
| 58 | insert ring fastener aperture |
| 60 | skirt |
| 70 | opening ring assembly |
| 72 | opening ring |
| 74 | opening ring fastener aperture |
| 80 | strap |
| 82 | strap fastener |
| 84 | strap buckle |
| 90 | belt assembly |
| 91 | belt strapping |
| 92 | female belt fastener |
| 94 | belt fastener aperture |
| 96 | belt buckle |
| 98 | belt apertures |
| 100 | trash bag |
| 102 | user |
| 104 | trash collection device |
| 106 | refuse |
| 110 | interference feature embodiment |

-continued

| DESCRIPTIVE KEY | |
|---|---|
| 115 | lip |
| 116 | tongue |
| 118 | groove |
| 120 | interference fit bag holding assembly |
| 121 | interference fit bag opening assembly |
| 130 | interference fit base assembly |
| 132 | interference fit base ring |
| 150 | interference fit insert assembly |
| 152 | interference fit insert ring |
| 170 | interference fit opening ring assembly |
| 172 | interference fit opening ring |
| 210 | clamp ring bag holding assembly |
| 215 | clamping ring |
| 216 | clamping ring handle |
| 230 | clamping ring base assembly |
| 232 | clamping ring base ring |
| 250 | clamping ring insert assembly |
| 252 | clamping ring insert ring |

DETAILED DESCRIPTION OF THE PREFERRED EMBODIMENT

Figure 4:
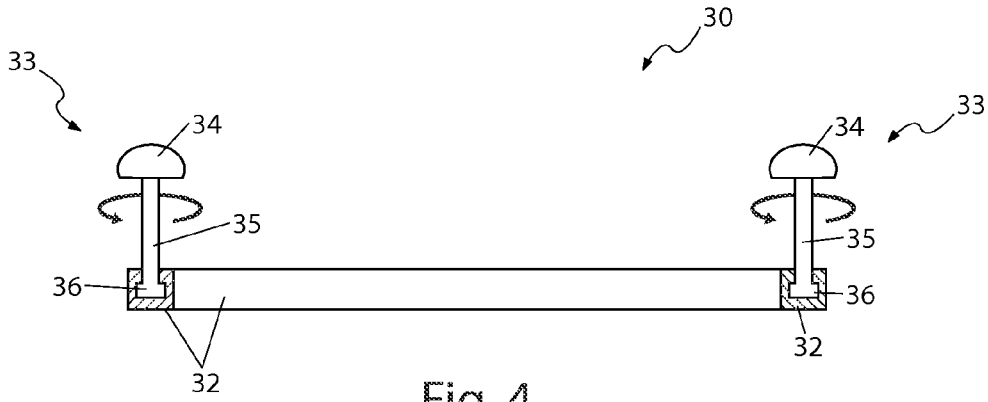
FIG. 4 is a section view of a base assembly of the bag holding assembly taken along section line A-A of FIG. 2, according to the preferred embodiment.
Figure 5:
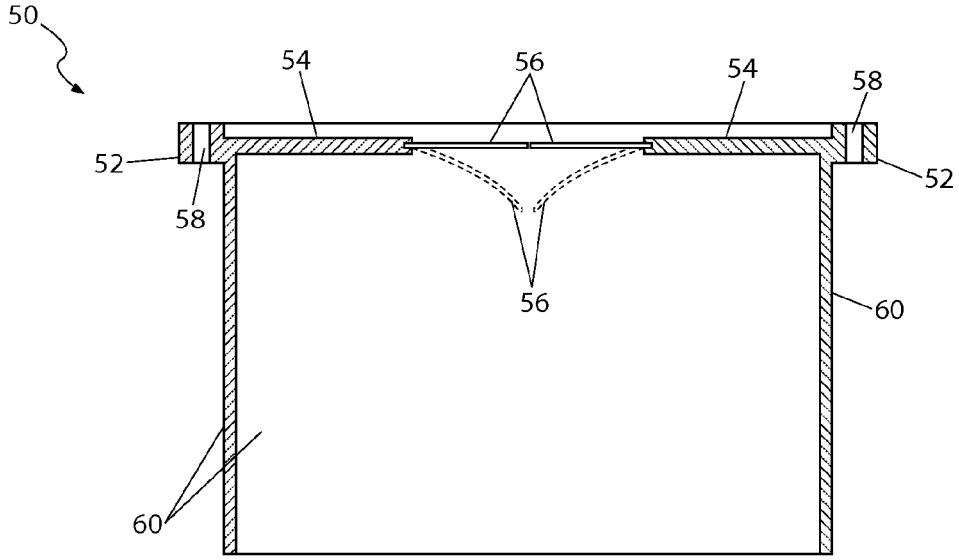
FIG. 5 is a section view of an insert assembly of the bag holding assembly taken along section line B-B of FIG. 2, according to the preferred embodiment.
Figure 6:
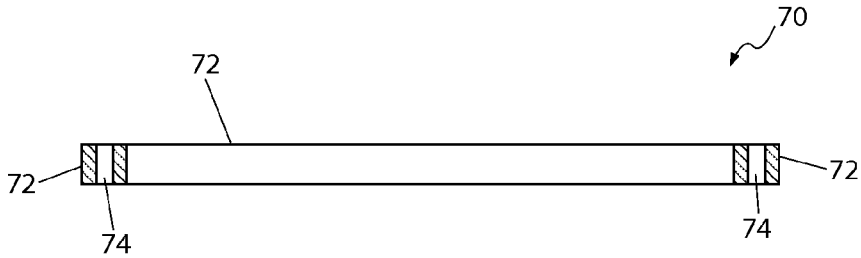
FIG. 6 is a section view of an upper clamping ring assembly of the bag opening assembly taken along section line C-C of FIG. 3, according to the preferred embodiment.

In accordance with the invention, the best mode is presented in terms of a preferred embodiment, herein depicted within FIGS. 1 through 5 and in terms of two (2) alternate embodiments, depicted within FIGS. 6 and 7*b*. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 13, depicting a personal trash bag holding apparatus (herein described as the "apparatus") 10, where like reference numerals represent similar or like parts. In accordance with the invention, the present disclosure describes the apparatus 10 which holds a pair of trash bags 100 in a hands-free manner to aid in manual picking up of refuse 106. The apparatus 10 generally includes a pair of bag holding assemblies 20 which hold respective standard can liner type trash bags 100.

Figure 1:
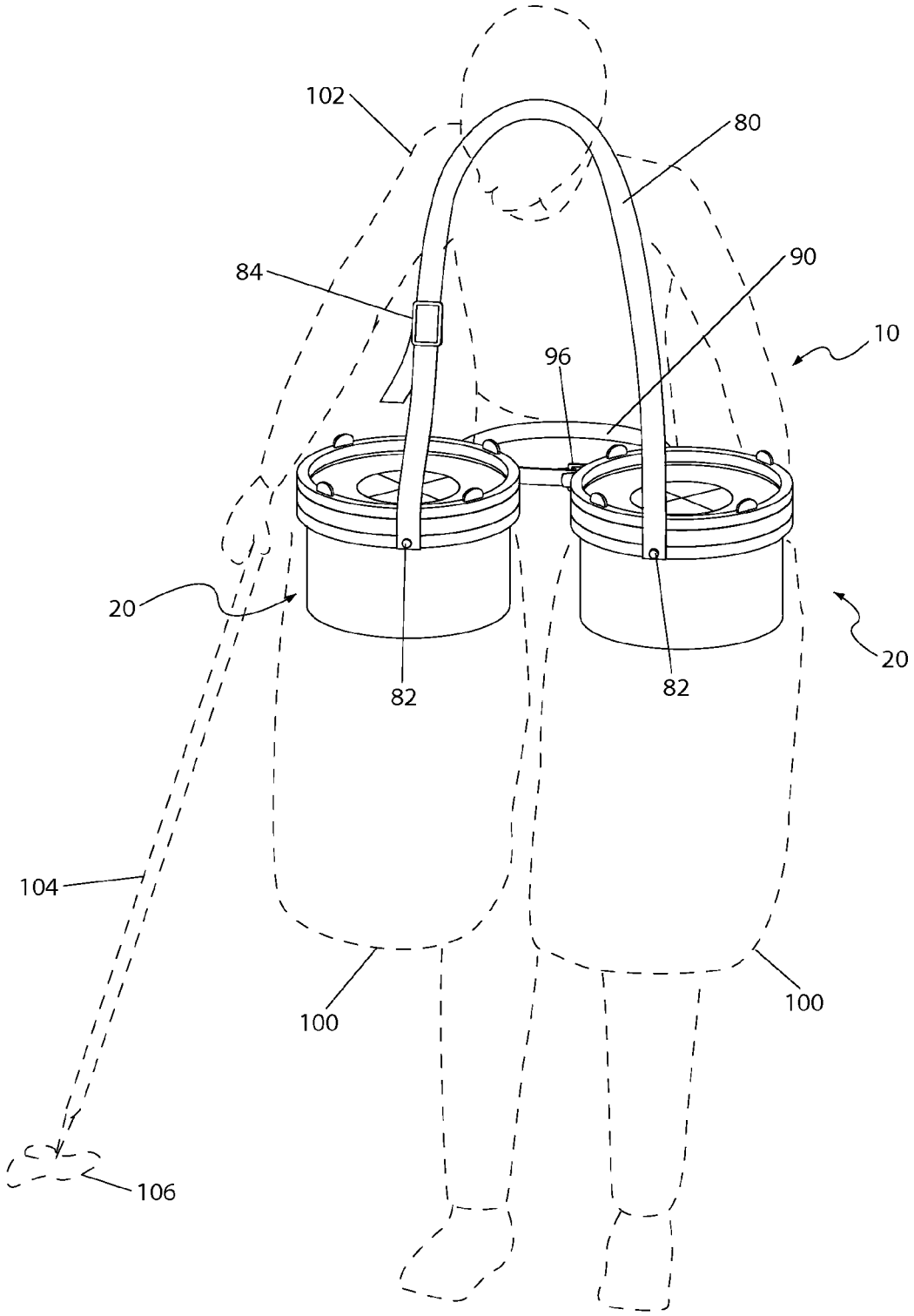
FIG. 1 is an environmental view of a personal trash bag holding apparatus, according to a preferred embodiment in accordance with the invention.

FIG. 1 shows an environmental view of the apparatus 10 depicted in an in-use state as worn by a user 102. The apparatus 10 generally includes a base assembly 30, an insert assembly 50, an opening ring assembly 70, a strap 80, and a supporting waist belt assembly 90. The base assembly 30, the insert assembly 50, and the opening ring assembly 70 are selectably combined for use a bag holding assembly 20 and a bag opening assembly 21, each of which is selectably usable with the strap 80 and waist belt assembly 90.

The bag holding assembly 20 includes the base assembly 30 and the insert assembly 50, used in combination. The base assembly 30 includes a base ring 32 and a plurality of fasteners 33 which selectively engage and retain the insert assembly 50 or the opening ring assembly 70. The insert assembly 50 includes an insert ring 52 having an upper panel 54 extending within the insert ring 52. A stripping membrane 56 is located centrally along the upper panel 54 having an "X"-shaped split opening to allow the user 102 to place refuse 106 inside the trash bag 100 through the bag holding assembly 20 while utilizing a trash collection device 104, such as a "paper picker" or equivalent tool. The refuse 106 is inserted through the stripping membrane 56 and the trash collection device 104 is wiped clean of the refuse 106 by the flexible finger portions of the stripping membrane 56 when removed. The opening ring assembly 70 includes an opening ring 32 which is fastened to the base ring 32 to provide a large framed opening for keeping the mouth of the trash bag 100 open during use.

The apparatus 10 allows for one-handed operation and in use a pair or bag holding assemblies 20 are fastenable to the waist belt assembly 90. The bag holding assemblies 20 each have an integral male belt fastener 38 along an outside perimeter edge of the base ring 32 that allows the user 102 to fasten and support the bag holding assemblies 20 or the bag opening assemblies 21 about a waist area to the belt assembly 90.

The shoulder strap 80 stabilizes the bag holding assemblies 20 and the bag opening assemblies 21 and distributes the load from the apparatus 10 and a corresponding refuse 106 filled trash bag 100. The strap 80 is preferably made of a durable vinyl or leather unitary strapping member which extends behind and around the user's 102 neck area and is removably connected to a forward outside edge of the base ring 32 by a respective strap fastener 82. The strap fasteners 82 are preferably fasteners which protrude outwardly from the perimeter edge of the bag holding assembly 20; such as bolts, screws, or the like. The strap 80 is length adjustable by use of a first buckle 84 to obtain a comfortable fit upon the user 102.

Figure 2:
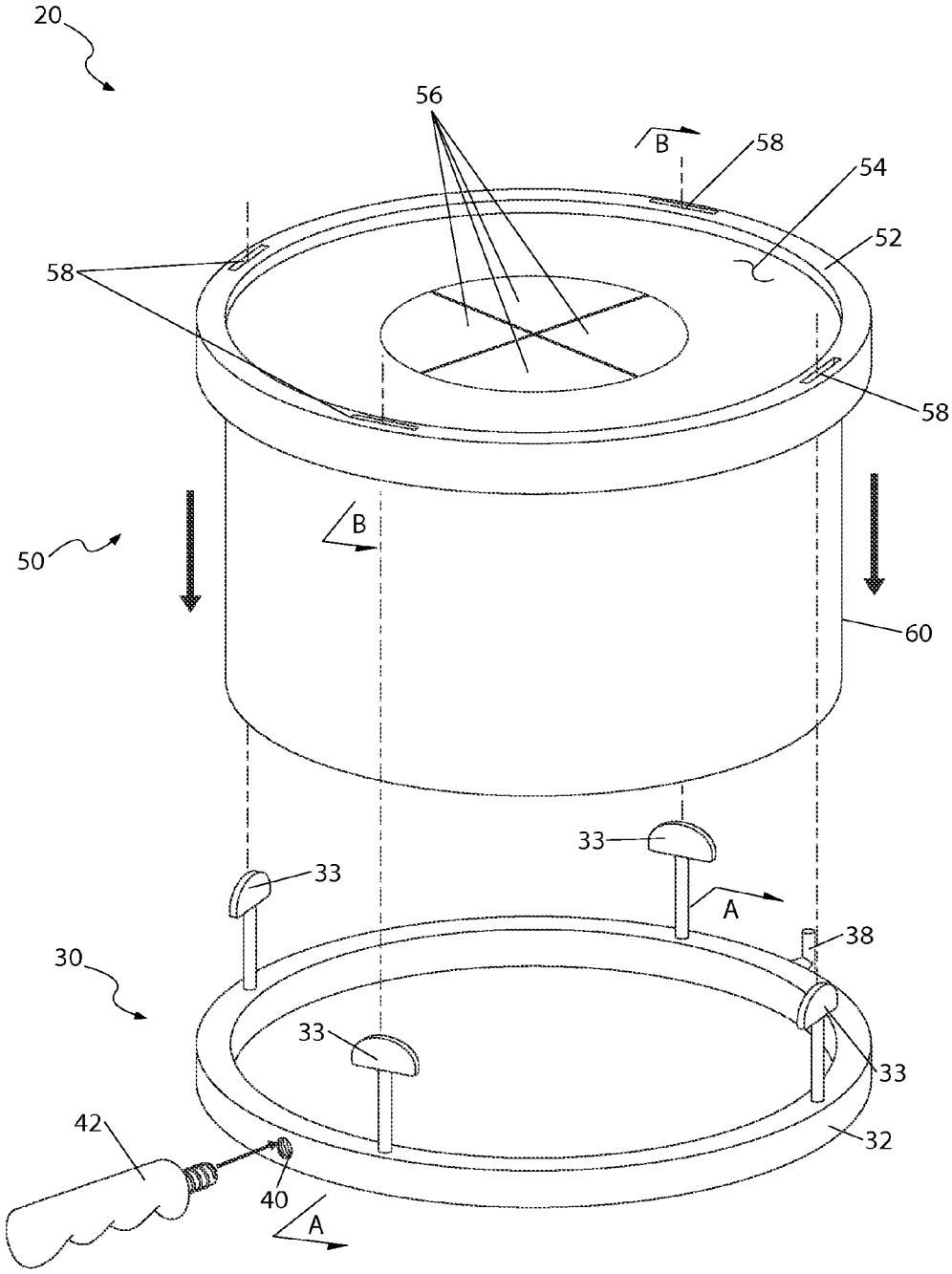
FIG. 2 is an exploded view of a bag holding assembly of the personal trash bag holding apparatus, according to the preferred embodiment.
Figure 3:
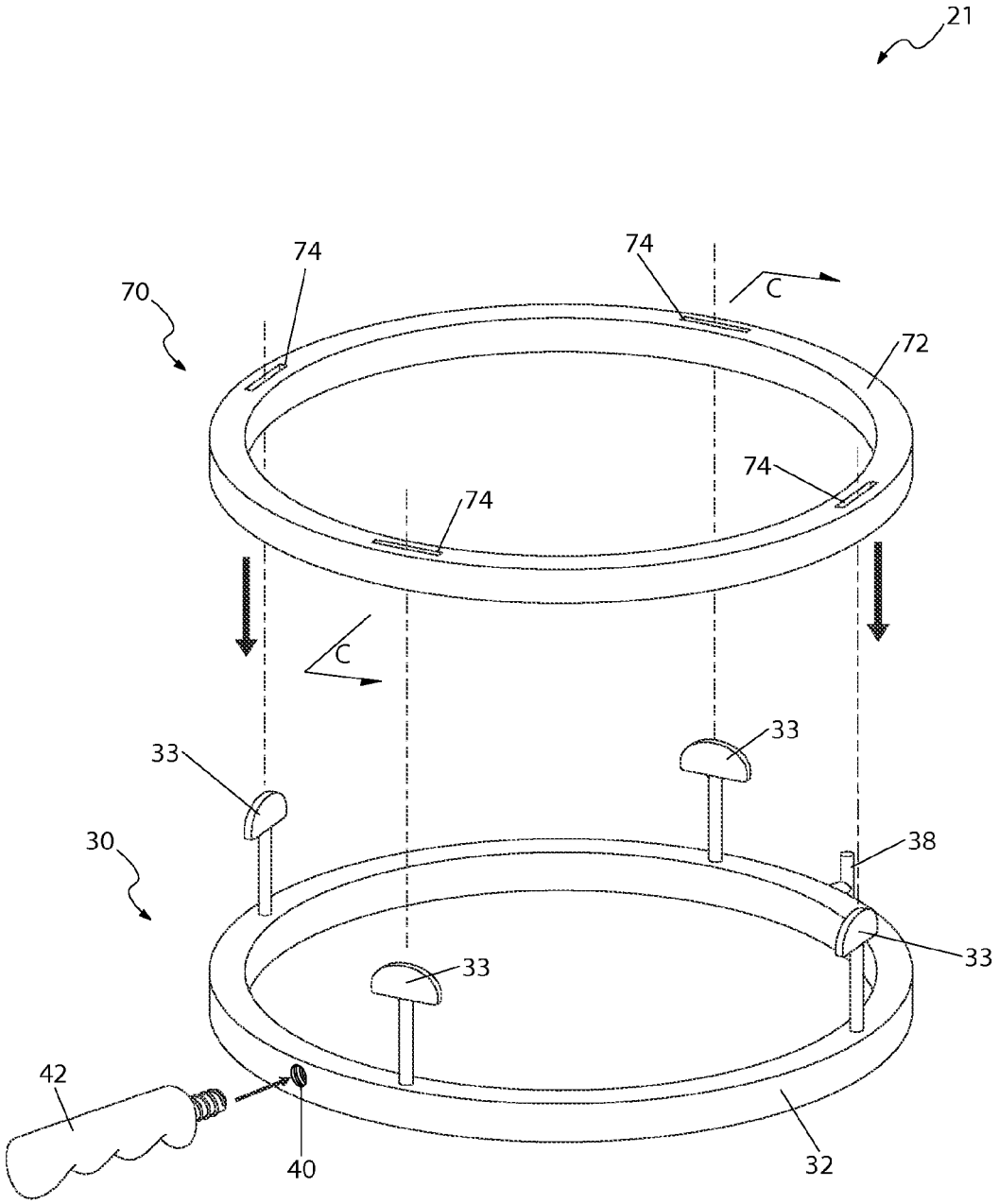
FIG. 3 is an exploded view of a bag opening assembly of the personal bag holding apparatus, according to the preferred embodiment.

FIGS. 2 and 3 show exploded views of the bag holding assembly 20 and the bag opening assembly 21, respectively. The base assembly 30, the insert assembly 50, and the opening ring assembly 70 are selectably stackable and retained together based on the intended use of the apparatus 10. FIGS. 4, 5, and 6 show section views of the base assembly 30, the insert assembly 50, and the opening ring assembly 70, respectively. Each of the three (3) stackable assemblies 30, 50, 70 is a ring-shaped structure having approximately equivalent outer diameters. While the outer diameter is envisioned to be approximately thirty (30) inches for use with most common sized trash bags 100, it can be appreciated that the assemblies 30, 50, 70 can be introduced having larger or smaller diameters based upon a particular size of trash bags 100 or a particular trash collecting task without deviating from the present disclosure and as such should not be interpreted as a limiting factor. The assemblies 30, 50, 70 are securely locked together by the four (4) equally-spaced twist fasteners 33 which entrap and clamp the edge portions of the trash bag 100 between the base ring 32 and the insert ring 52 or between the base ring 32 and the opening ring 72, depending upon usage.

The base assembly 30 includes the base ring 32, the four (4) twist fasteners 33, the male belt fastener 38, a threaded aperture 40, and a handle 42. The base ring 32 is approximately one (1) inch in height and approximately one (1) inch in width. The base ring 32 is preferably made using a rigid molded plastic composition or a light-weight metal, such as aluminum, providing sufficient structural integrity and sufficient top surface area for clamping the trash bag 100. The twist fasteners 33 are rotatably attached to a top horizontal surface of the base ring 32 and extend vertically upward.

Figure 7:
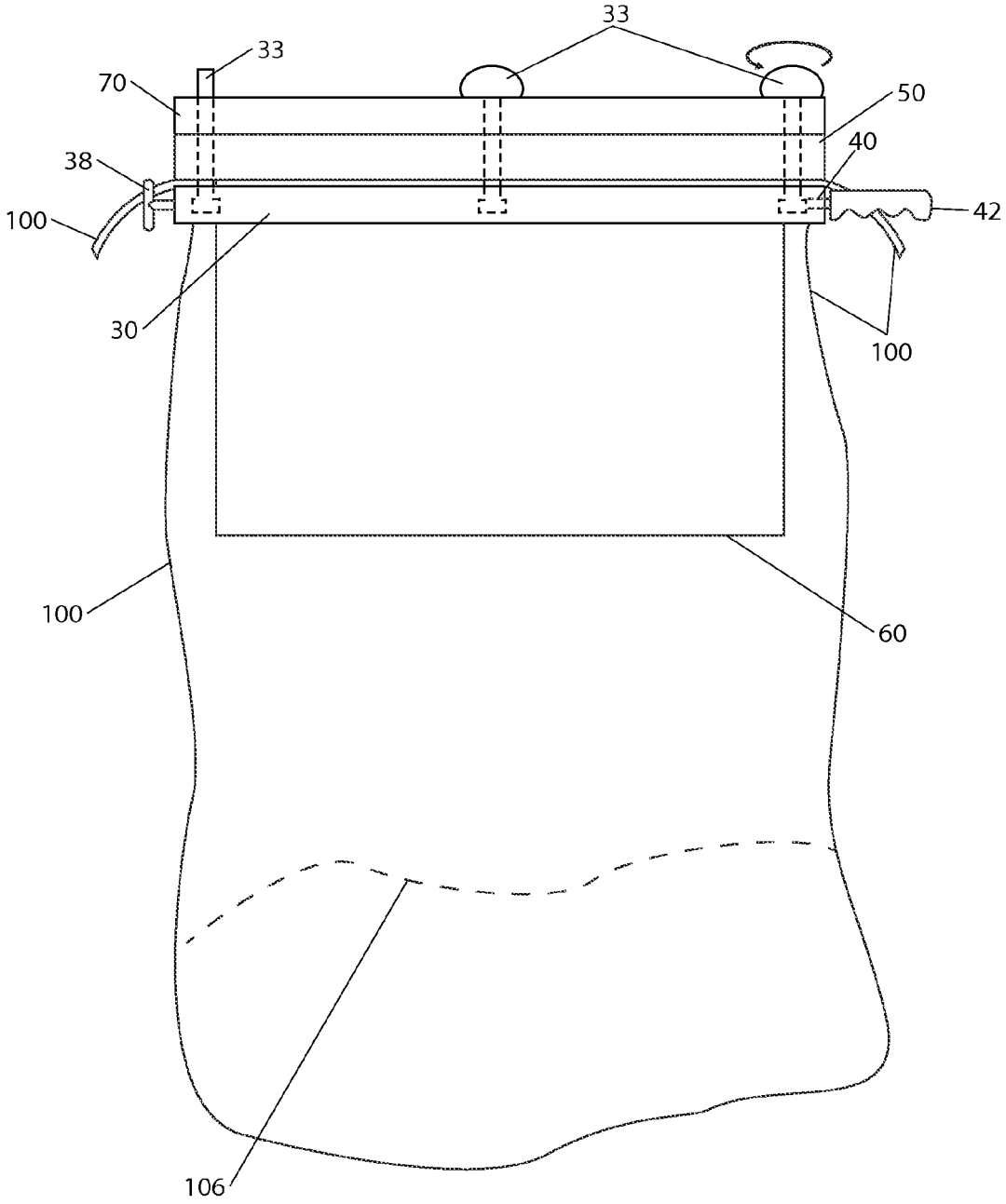
FIG. 7 is a side environmental view of the bag holding assembly, according to the preferred embodiment.
Figure 8:
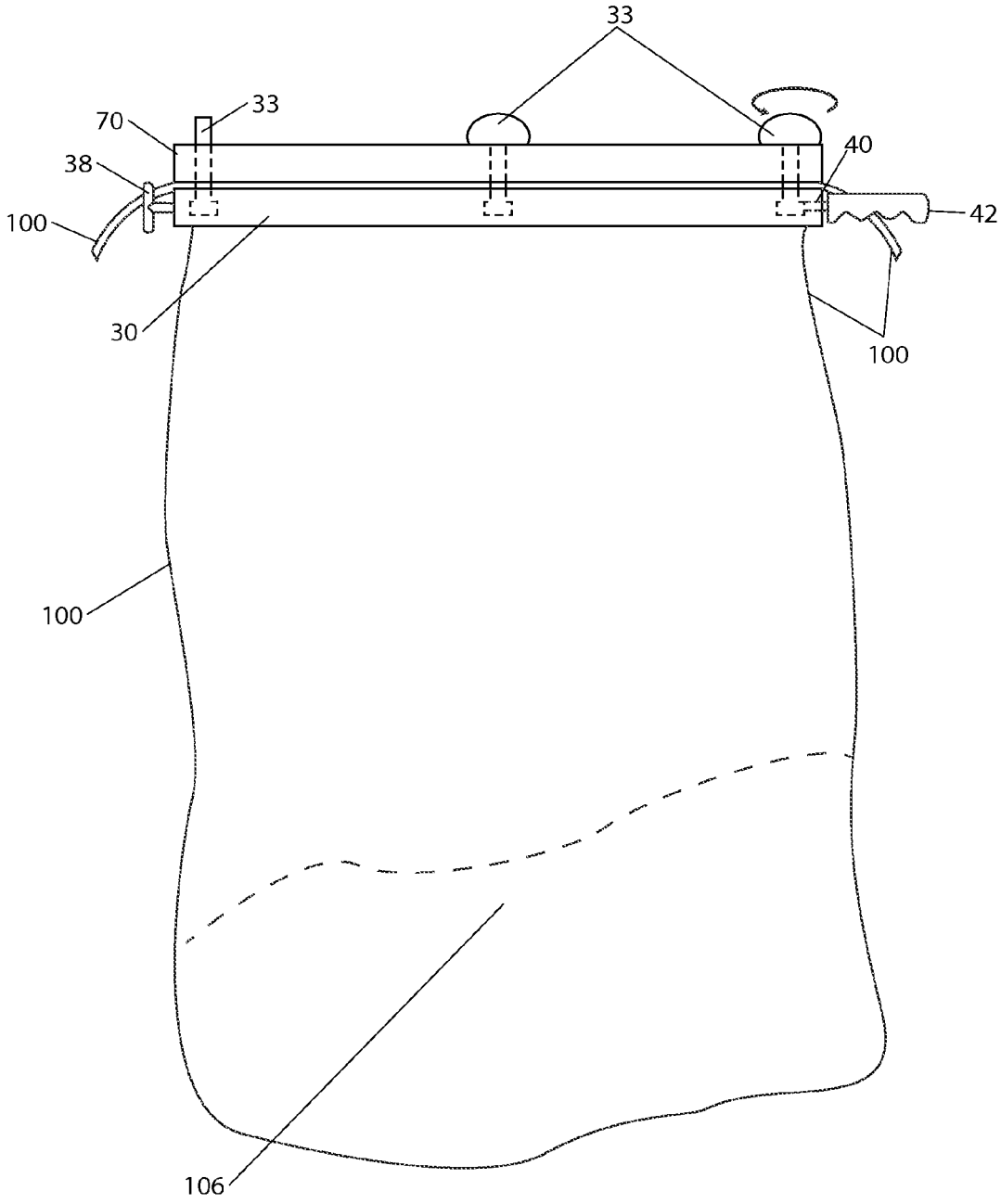
FIG. 8 is a side environmental view of the bag opening assembly, according to the preferred embodiment.

Each twist fastener 33 has a vertically extending and semi-circular-shaped head feature 34, a vertical shaft 35, and a keeper feature 36 rotatably attached within the base ring 32. The keeper feature 36 is an entrapped cylinder having a "T"-shaped bottom end allowing for free rotation of the twist fastener 33 about a vertical axis. The twist fasteners 33 lock the base ring 32 and the selected insert ring 52 or opening ring 72 together by coincidental insertion of the upper head feature 34 through correspondingly positioned oval-shaped insert ring apertures 58 or opening ring fastener apertures 74 disposed through the insert ring 52 and the opening ring 72, respectively. The head feature 34 is manually rotated ninety degrees (90°) to lock and retain the selected pair of assemblies 30, 50, 70 and the entrapped trash bag 100 in position as seen in FIGS. 1, 7, and 8.

The threaded aperture 40 is located approximately opposite the male belt fastener 38 and provides for the attachment the strap 80 to the base assembly 30 by utilizing the strap fastener 82 which threadingly engages the threaded aperture 40. The threaded aperture 40 is also used to threadingly attach the handle 42 in such cases as when the bag holding assembly 20 or the bag opening assembly 21 is used in a stand-alone mode held by the user 102. In the stand-alone mode the user 102 grips and supports the bag holding assembly 20 or the bag opening assembly 21 in one (1) hand using the handle 42 while picking refuse 106 with the opposite hand.

The insert assembly 50 is a unitary construction including the insert ring 52 being approximately one-quarter (¼) of an inch thick and having the integral rigid horizontal upper panel 54 which extends horizontally across an inner diameter of the insert ring 52. The upper panel 54 includes the permanently attached and centrally located stripping membrane 56 which is preferably affixed to the upper panel 54 using plastic bonding methods such as adhesives, plastic welding, heat-sealing, or the like. The stripping membrane 56 provides for unidirectional flexing during insertion of refuse 106 by the user 102. The stripping membrane 56 has a generally circular surface separated into quadrants by an "X"-shaped sliced pattern and is preferably made of a durable flexible plastic material.

The insert ring fastener apertures 58 are formed through the insert ring 52 and a cylindrical skirt 60 extends downwardly from the inner diameter of the insert ring 52. The skirt 60 is a hollow generally cylindrical structure which extends downwardly into the trash bag 100 approximately twelve (12) inches. The skirt 60 protects the trash bag 100 from possible damage from the trash collection device 104 when inserted through the stripping membrane 56.

The opening ring 72 is approximately one-quarter (¼) of an inch thick having the four (4) integrally-molded oval-shaped opening ring fastener apertures 74. The opening ring 72 provides a downward clamping force to the base assembly 30 and the entrapped trash bag 100 by engagement of the twist fasteners 33 through the opening ring fastener apertures 74 and subsequent rotation of respective head features 34 of the twist fasteners 33. This combination maintains the mouth of the trash bag 100 in a fully open condition.

FIGS. 7 and 8 show plan views of the bag holding assembly 20 and the bag opening assembly 21 in an in use state having the handle 42 attached. In use, the trash bag 100 is inserted through the base ring 32 and the upper open end is folded over the outside perimeter of the base ring 32. For use as the bag holding assembly 20, the insert assembly 50 is inserted within the bag through the base ring 32 such that the upper open end is compressed between the assemblies 30, 50. The fasteners 33 push through the bag and are inserted into the corresponding insert ring fastener apertures 58 and rotated to secure the rings 32, 52 together. For use as the bag opening assembly 21, the opening ring assembly 70 is placed over the trash bag 100 atop the base ring 32 such that the upper open end of the bag 100 is compressed between the assemblies 30, 70. The fasteners 33 push through the bag and are inserted into the corresponding opening ring fastener apertures 78 of the opening ring 72 and rotated to secure the rings 32, 72 together. In either state of use, the handle 42 can be threadingly attached to the threaded aperture 40 for the user to hold the apparatus 10.

Figure 9:
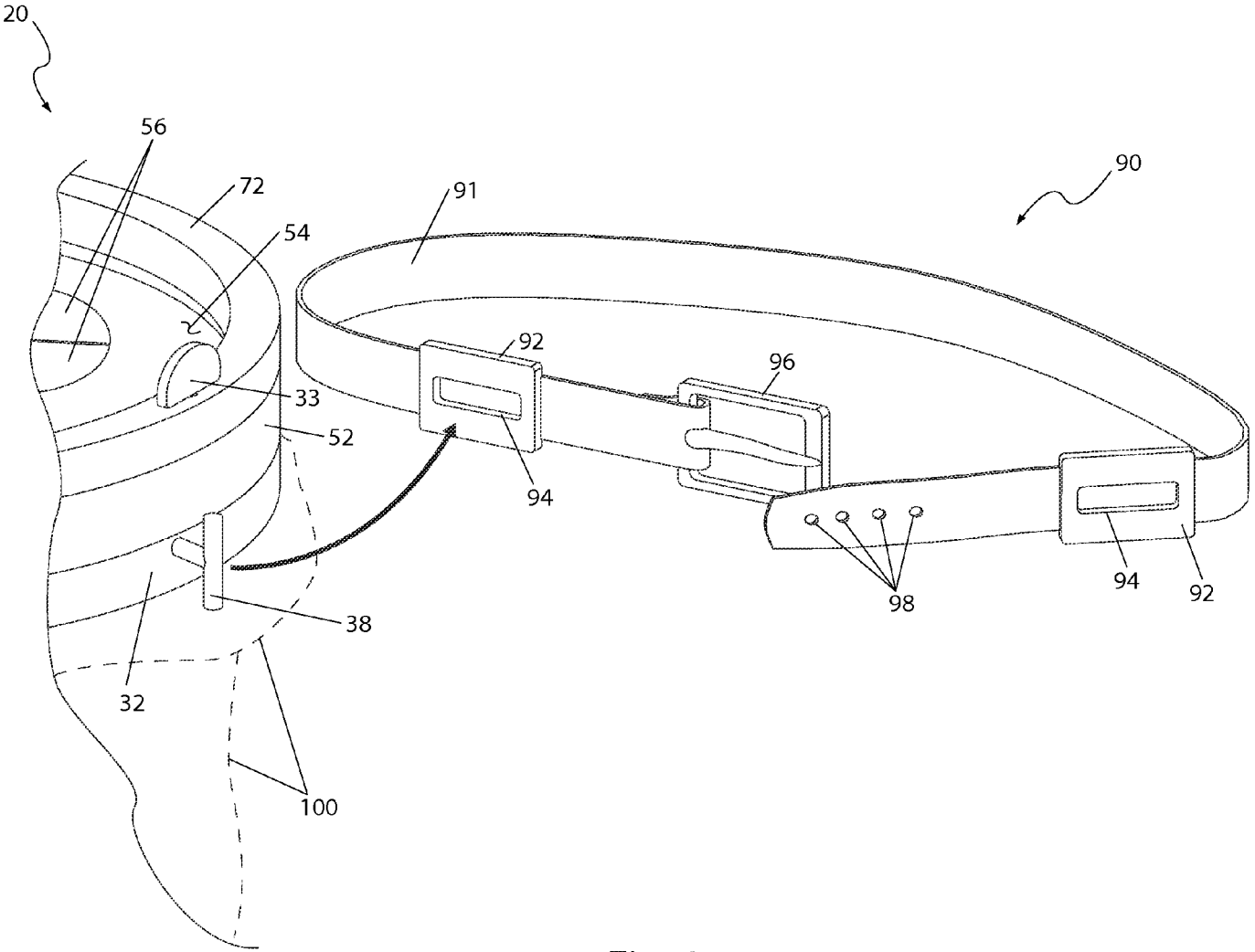
FIG. 9 is a close-up view of a belt assembly of the personal trash bag holding apparatus, according to the preferred embodiment.

FIG. 9 shows a close-up view of the waist belt assembly 90. The belt assembly 90 provides for the attachment of and supports the weight of the bag holding assemblies 20 or the bag opening assemblies 21. The belt assembly 90 includes the length of belt strapping 91 preferably made of a durable load-bearing material such as vinyl, leather, nylon, or the like and having ample width so as to provide distribution of the weight of a fully loaded apparatus 10 while providing ergonomic support of the user's 102 back during use. The belt strapping 91 also includes a pair of permanently affixed hollow female belt fasteners 92 positioned and aligned with the user's general hip area to support the weight of the apparatus 10.

The male belt fastener 38 is a rigidly affixed "T"-shaped appendage extending outwardly from a side surface of the base ring 32. The "T"-shaped head is orientated vertically to provide for an insert-and-turn-type locking engagement with a corresponding female belt fastener 92 attached to the belt strapping 91 of the belt assembly 90 to securely retain the bag holding assembly 20 and bag opening assembly 21 to the belt assembly 90.

The female belt fasteners 92 are rugged hollow metal or plastic rectangular enclosures capable of supporting the weight of the apparatus 10 laden with the loaded trash bags 100. Each female belt fastener 92 has an integral and forwardly facing horizontal belt fastener aperture 94 sized to slidingly receive and retain the male belt fastener 38 of each respective base assembly 30. The male 38 and female 92 belt fasteners provide a quarter-turn locking engagement of the bag holding assembly 20 to the belt assembly 90 by rotating the base assembly 30 ninety degrees (90°) to a vertical orientation; inserting the male belt fastener 38 into the belt fastener aperture 94 of the female belt fastener 92; and, returning the base assembly 30 to an operable horizontal orientation. The belt assembly 90 also provides a length adjustment mechanism, preferably a standard center-bar-type second buckle 96 and a plurality of corresponding belt apertures 98 to provide a comfortable fit to different shaped users 102.

Figure 10:
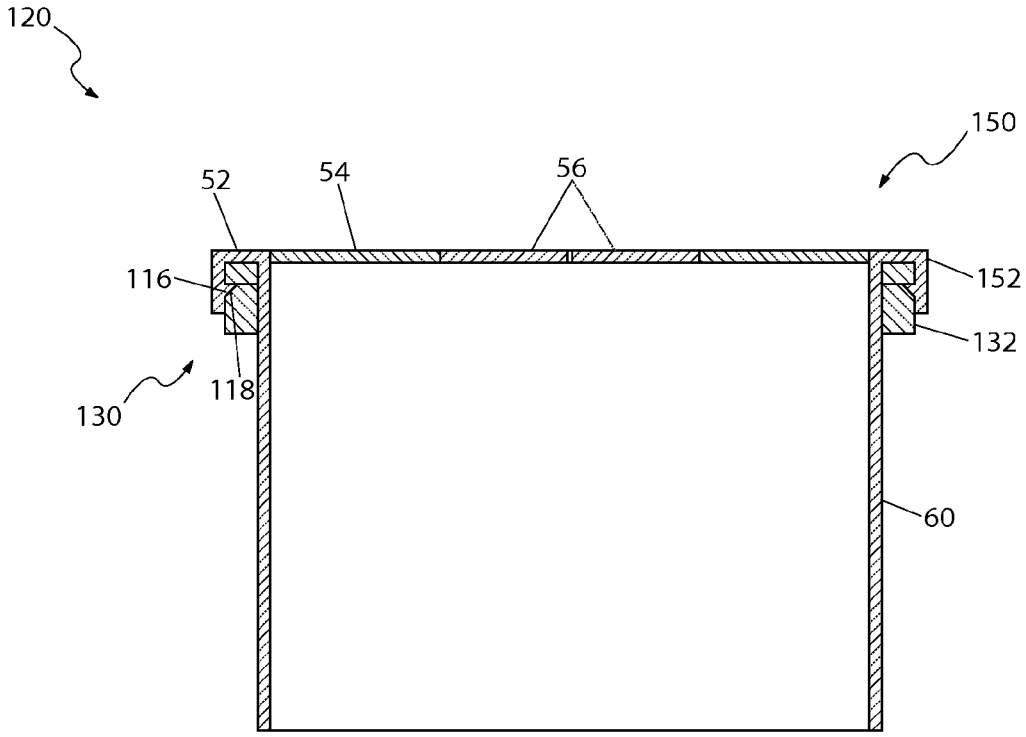
FIG. 10 is a section view of an interference fit embodiment of the bag holding assembly, according to an alternate embodiment in accordance with the invention.
Figure 11:
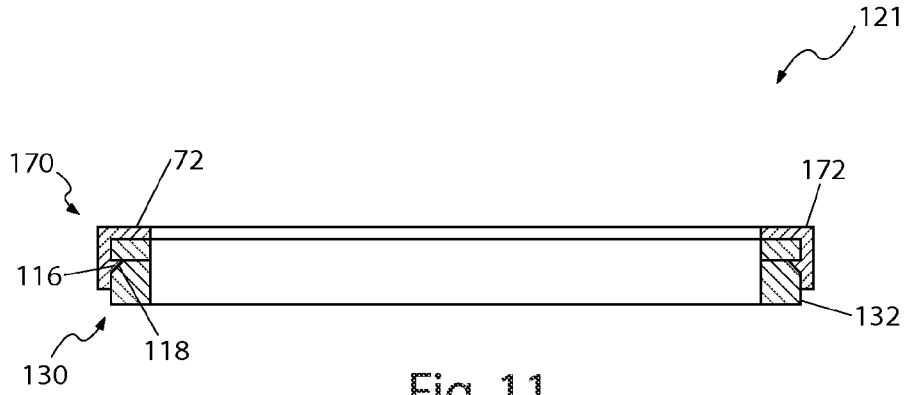
FIG. 11 is a section view of the interference fit embodiment of the bag opening assembly, according to an alternate embodiment in accordance with the invention.

FIGS. 10 and 11 show section views of an interference fit bag holding assembly 120 and an interference fit bag opening assembly 121, respectively. These alternate embodiments include substantially similar structural and functional features as described and operate in a similar manner. The interference fit bag holding assembly 120 and the interference fit bag opening assembly 121 provide for a snap-on attachment of an interference insert assembly 150 or an interference opening ring assembly 170 to an interference base ring assembly 130, respectively. In lieu of the previously described twist fasteners 33, the apparatus 10 provides for effective snap-on interference fit connection of the selected pairs of interference assemblies 130, 150, 170 to secure the trash bag 100 there between in position. The interference insert ring 152 and the interference opening ring 172 each include a downwardly extending perimeter lip 115 which extends around an entire perimeter of thereof. The lip 115 has a plurality of integrally-molded hook-shaped tongue features 116 arranged along an inner surface designed to hook into a corresponding annular locking groove 118 integrally-molded around the perimeter of the interference fit base ring 132.

Figure 12:
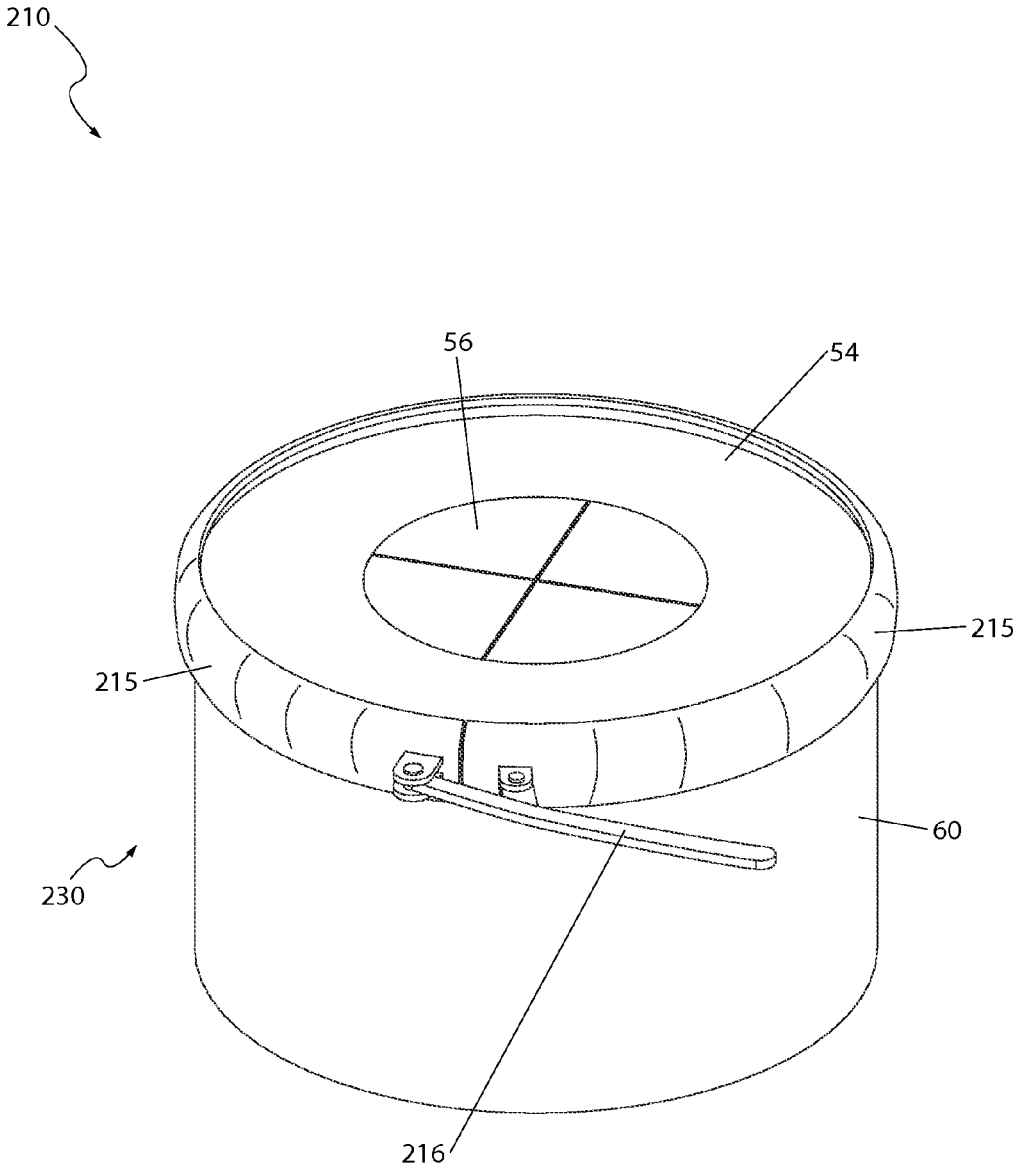
FIG. 12 is a perspective view of a clamp ring embodiment of the bag holding assembly, according to an alternate embodiment in accordance with the invention; and, FIG. 13 is a section view of the clamp ring embodiment, according to an alternate embodiment in accordance with the invention.
Figure 13:
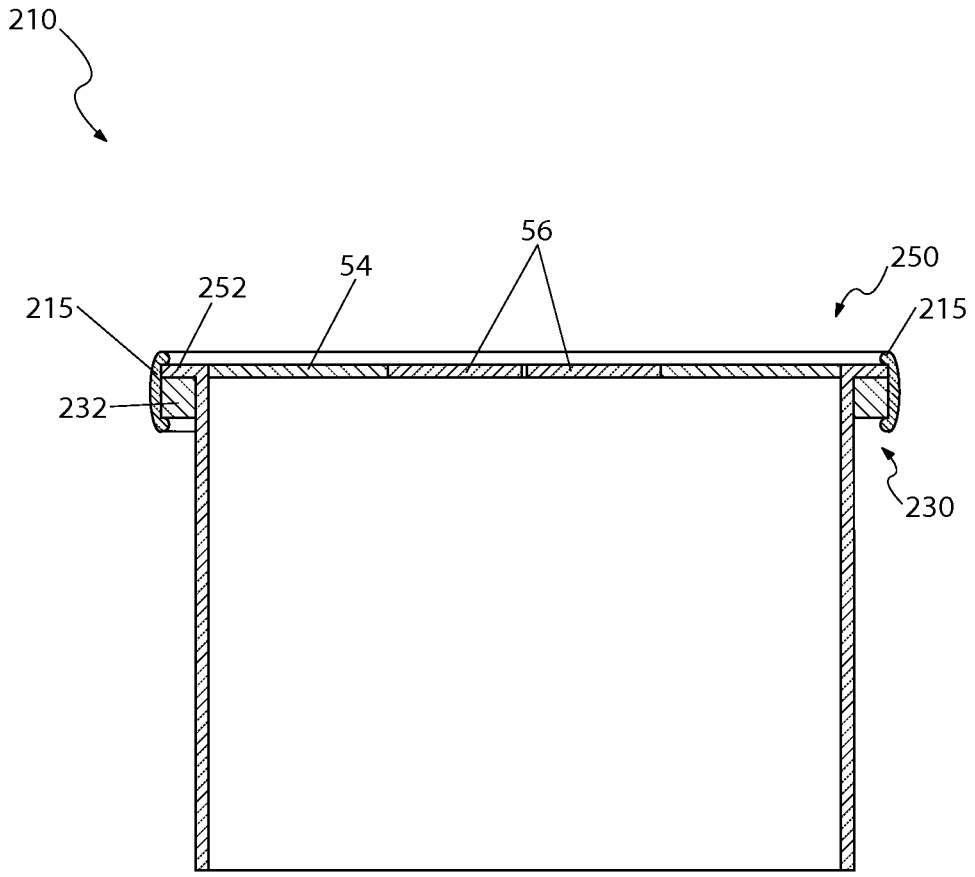

FIGS. 12 and 13 show an environmental and section view of a clamp ring bag holding assembly 220, respectively. These alternate embodiments include substantially similar structural and functional features as described and operate in a similar manner. The clamping ring bag holding assembly 220 and a clamping ring bag opening assembly are secured together by use of a clamping ring 215. In lieu of the previously described attachments, the apparatus 10 provides the clamping ring 215 to securely retain the selected clamping ring insert assembly 250 or the clamping ring opening assembly to the clamping ring base assembly 230 to secure the trash bag 100 therebetween and in position. A clamping ring base ring 232 has a rounded lower perimeter edge and a clamping insert ring 252 and a clamping opening ring each have a rounded upper perimeter edge, thereby enabling installation of the lever-released clamping ring 215, which is preferably similar to those used to seal drum-type containers. The clamping ring 215 is circumferentially suitably sized to fit snuggly around the selected pairs of clamping ring assemblies. The clamping ring 215 has an arcuate inner profile shape to compress the clamping ring base ring 232 and the clamping insert ring 252 together as shown or the clamping ring base ring 232 and the clamping opening together, not shown in the figure. The clamp ring 126 preferably includes a manual releasing and clamping lever handle 216 along a perimeter edge.

In accordance with the invention, the preferred embodiment can be utilized by the user in a simple and effortless manner with little or no training. After initial purchase or acquisition of the apparatus 10, it is utilized to contain trash items 106 as indicated in FIGS. 1, 7, and 8.

The method of installing the apparatus 10 can be achieved by performing the following steps: procuring a model of the apparatus 10 having a particularly sized set of bag holding assemblies 20 and bag opening assemblies 21 having a desired diameter based upon a particular trash bag 100 size or a particular trash collecting task; installing the belt assembly around the user's waist using the second buckle 96 and corresponding belt apertures 98 to obtain a comfortable fit; attaching one (1) bag holding assembly 20 to the belt assembly 90 by rotating the bag holding assembly 20 ninety degrees) (90° from horizontal; inserting the male belt fastener 38 into the belt fastener aperture 94 of the female belt fastener 92 of the belt assembly 90; returning the bag holding assembly 20 to an operable horizontal orientation; fastening one (1) end portion of the strap assembly 80 to the threaded aperture 40 of the base ring 32 using the strap fastener 82; repeating the above steps to attach the remaining bag holding assembly 20 to the belt assembly 90 and the remaining end of the strap 80; assembling a trash bag 100 to one (1) bag holding assembly 20, removing the insert assembly 50 from the base assembly 30, if previously installed, by rotating the four (4) twist fasteners 33 until parallel with the corresponding insert ring fastener apertures 58; lifting the insert 50 assemblies; inserting the open end of the trash bag 100 upwardly through the base assembly 30; draping edge portions of the trash bag 100 outwardly and over the base ring 32; pressing and puncturing the edge portions of the trash bag 100 onto the twist fasteners 33 to position and stabilize the trash bag 100; placing the insert assembly 50 onto the base assembly 30 by inserting the twist fasteners 33 through the insert ring fastener apertures 58, thereby entrapping the trash bag 100 therebetween; giving special care to insert the skirt 60 of the insert assembly 50 smoothly into the trash bag 100; rotating the head features 34 of the twist fasteners 33 ninety (90) degrees to secure the trash bag 100 and lock the assemblies 30, 50 of the bag holding assembly 20 together; repeating the above steps to secure another trash bag 100 to the remaining bag holding assembly 20; adjusting a length of the shoulder strap 80 as needed to obtain a comfortable fit and desired load distribution, using the first buckle 84 of the shoulder strap 80; and, utilizing the apparatus 10 to collect and contain refuse 106.

The method of utilizing the apparatus 10 can be achieved by performing the following steps: utilizing the apparatus 10 in conjunction with additional trash collection devices 104 such as a "paper picker" or other desired tools, to reach, secure, and transport refuse 106 to the apparatus 10; inserting the refuse 106 using the collection device 104 downwardly through the stripping membrane 56; retracting an end portion of the trash collecting device 104 from the stripping membrane 56 to strip and retain the refuse 106 within the trash bag 100; repeating the collection process as needed until the trash bags 100 are full; releasing a full trash bag 100 from the bag holding assemblies 20 by rotating the twist fasteners 33; removing the insert assembly 50 and the full trash bag 100; disposing of the trash bag 100 and contained refuse 106 in a sanitary manner; and, replacing the trash bag 100 as previously described above.

The method of utilizing the interference fit embodiment can be achieved by performing the following additional steps: securing the interference fit insert ring 152 ring to the interference fit base ring 132 by pressing the lip 115 of the interference fit insert ring 152 down over the interference fit base ring 1132; and, continuing to press downwardly until obtaining a snapping engagement of the interference tongue features 116 engage the corresponding locking groove 118 of the interference fit base ring 113.

The method of utilizing the clamp ring embodiment 120 can be achieved by performing the following additional steps: placing the clamping ring 215 around the pre-assembled clamping ring base assembly 230 and clamping ring insert assembly 250; and, securing the clamping ring base ring 232 and the clamping ring insert ring 252 together by circumferentially reducing the clamp ring 215 by pressing and locking the clamp ring handle 216.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A trash bag holding apparatus comprising:

a base assembly having an opening therethrough for receiving a trash bag such that an upper perimeter edge of said trash bag is foldable over a circumferential edge of said base assembly;

an insert assembly having a central insert opening for receiving refuse selectably attachable to said base assembly to retain said upper perimeter of said trash bag between opposing surfaces thereof;

a strap wearable around the shoulders of a user and removably attachable between a pair of said base assemblies;

a belt wearable around the waist of said user such that said pair of base assemblies are each removably attachable to a pair of belt fasteners of said belt; and, a base ring comprising a pair of protruding "T"-shaped fasteners each insertingly attachable to an individual belt fastener to attach said base ring to said belt.

2. The apparatus of claim 1, further comprising an opening ring assembly having an opening therethrough selectably attachable to said base assembly in place of said insert assembly to retain said upper perimeter of said trash bag between opposing surfaces thereof to support said trash bag in an open position.

3. The apparatus of claim 1, wherein said insert assembly further comprises:

an insert ring having an upper panel extending across an inner diameter to said insert opening;

a hollow cylindrical skirt extending downwardly from said inner diameter of said insert ring; and, a flexible stripping membrane affixed to said insert opening.

4. The apparatus of claim 3, wherein said stripping membrane further comprises a rubberized circular member having an "X"-shaped slit defining four flexible fingers.

5. The apparatus of claim 1, further comprising a handle removably attached to said base assembly.

6. The apparatus of claim 2, wherein said base ring further comprises a plurality of twist fasteners rotatably attached to an upper surface thereof; and, wherein said insert ring and said opening ring each further comprises a plurality of fastener apertures disposed therethrough to receive said twist fasteners when said insert ring or said opening ring is selectably attached to said base ring.

7. The apparatus of claim 2 wherein said base ring further comprises a groove disposed circumferentially along an outside surface; and, wherein said insert ring and said opening ring each further comprises a downwardly protruding lip having an inwardly protruding tongue to matingly engage said groove when said insert ring or said opening ring is selectably attached to said base ring.

8. The apparatus of claim 2, further comprising a clamping ring adapted to circumferentially enclose said base ring and said insert ring or said opening ring when selectably mated together to attach the same.

9. A trash bag holding apparatus comprising:

a base ring having an open inner diameter to receive a trash bag therethrough such that an upper perimeter edge of said trash bag is foldable over a circumferential edge of said base assembly;

an insert ring having a closed inner diameter with a central insert opening for receiving refuse therethrough and a downwardly protruding hollow cylindrical skirt having a diameter slightly smaller than said base ring inner diameter;

an opening ring having an open inner diameter approximately equal to said base ring inner diameter; and, a handle removably attachable to said base ring;

wherein said insert ring is attachable to said base ring such that said skirt is inserted through said base ring inner diameter and into said trash bag, such that said upper perimeter of said trash bag is secured between opposing surfaces thereof;

wherein said opening ring is attachable to said base ring, such that said upper perimeter of said trash bag is secured between opposing surfaces thereof to support said trash bag in an open position;

said insert opening further comprises a circular stripping member having an "X"-shaped slit defining four flexible fingers;

wherein said base ring further comprises a plurality of twist fasteners rotatably attached to an upper surface thereof; and wherein said insert ring and said opening ring each further comprises a plurality of fastener apertures disposed therethrough to receive said twist fasteners when said insert ring or said opening ring is selectably attached to said base ring.

10. The apparatus of claim 9, wherein said base ring further comprises a groove disposed circumferentially along an outside surface; and, wherein said insert ring and said opening ring each further comprises a downwardly protruding lip having an inwardly protruding tongue to matingly engage said groove when said insert ring or said opening ring is selectably attached to said base ring.

11. The apparatus of claim 9, further comprising a clamping ring adapted to circumferentially enclose said base ring and said insert ring or said opening ring when selectably mated together to attach the same.

12. A trash bag holding apparatus comprising:

a pair of base rings each having an open inner diameter to receive a trash bag therethrough such that an upper perimeter edge of said trash bag is foldable over a circumferential edge of said base assembly;

a pair of insert rings each having a closed inner diameter with a central insert opening for receiving refuse therethrough and a downwardly protruding hollow cylindrical skirt having a diameter slightly smaller than said base ring inner diameter;

a pair of opening rings each having an open inner diameter approximately equal to said base ring inner diameter;

a strap wearable around the shoulders of a user and removably attachable between said pair of base assemblies; and, a belt wearable around the waist of said user such that said pair of base assemblies are each removably attachable to a pair of belt fasteners of said belt opposite said strap;

wherein each of said insert rings is attachable to said base ring such that said skirt is inserted through said base ring inner diameter and into said trash bag, such that said upper perimeter of said trash bag is secured between opposing surfaces thereof; and, wherein each of said opening rings is attachable to said base ring, such that said upper perimeter of said trash bag is secured between opposing surfaces thereof to support said trash bag in an open position.

13. The apparatus of claim 12, wherein said insert opening further comprises a circular stripping member having an "X"-shaped slit defining four flexible fingers.

14. The apparatus of claim 13, wherein said base ring further comprises a plurality of twist fasteners rotatably attached to an upper surface thereof; and, wherein said insert ring and said opening ring each further comprises a plurality of fastener apertures disposed therethrough to receive said twist fasteners when said insert ring or said opening ring is selectably attached to said base ring.

15. The apparatus of claim 13, wherein said base ring further comprises a groove disposed circumferentially along an outside surface; and, wherein said insert ring and said opening ring each further comprises a downwardly protruding lip having an inwardly protruding tongue to matingly engage said groove when said insert ring or said opening ring is selectably attached to said base ring.

16. The apparatus of claim 13, further comprising a clamping ring adapted to circumferentially enclose said base ring and said insert ring or said opening ring when selectably mated together to attach the same.

* * * * *